US011603843B2

(12) United States Patent
Liang et al.

(10) Patent No.: US 11,603,843 B2
(45) Date of Patent: Mar. 14, 2023

(54) OIL SUPPLYING MECHANISM, AND HORIZONTAL COMPRESSOR HAVING SAME

(71) Applicant: EMERSON CLIMATE TECHNOLOGIES (SUZHOU) CO., LTD., Jiangsu (CN)

(72) Inventors: Sheng Liang, Suzhou (CN); Laurent Grignard, Suzhou (CN)

(73) Assignee: Emerson Climate Technologies (Suzhou) Co., Ltd., Jiangsu (CN)

( * ) Notice: Subject to any disclaimer, the term of this patent is extended or adjusted under 35 U.S.C. 154(b) by 117 days.

(21) Appl. No.: 16/957,698

(22) PCT Filed: Dec. 26, 2018

(86) PCT No.: PCT/CN2018/123893
§ 371 (c)(1),
(2) Date: Jun. 24, 2020

(87) PCT Pub. No.: WO2019/129057
PCT Pub. Date: Jul. 4, 2019

(65) Prior Publication Data

US 2020/0362863 A1 Nov. 19, 2020

(30) Foreign Application Priority Data

Dec. 27, 2017 (CN) ..... 201721861898.7

(51) Int. Cl.
*F04C 29/02* (2006.01)

(52) U.S. Cl.
CPC ..... *F04C 29/028* (2013.01); *F04C 29/025* (2013.01); *F04C 29/026* (2013.01);
(Continued)

(58) Field of Classification Search
CPC .... F04C 29/028; F04C 29/025; F04C 29/023; F04C 2240/603
See application file for complete search history.

(56) References Cited

U.S. PATENT DOCUMENTS 3,434,656 A * 3/1969 Bellmer ..... F04C 29/023 418/94
5,358,392 A 10/1994 Ukai
(Continued)

FOREIGN PATENT DOCUMENTS

CN 1467378 A 1/2004
CN 205578273 U 9/2016
(Continued)

OTHER PUBLICATIONS

English translation of JP-11006480 by Dialog, Oct. 25, 2021.*
(Continued)

*Primary Examiner* — Deming Wan
(74) *Attorney, Agent, or Firm* — Harness, Dickey & Pierce, P.L.C.

(57) ABSTRACT

Disclosed are an oil supplying mechanism, and a horizontal compressor having same. Disclosed is an oil supply mechanism for a horizontal compressor, the horizontal compressor including a housing, a motor, a rotating shaft driven by the motor, and a bearing pedestal supporting the rotating shaft. The oil supply mechanism includes a separating member, the separating member being in the form of a ring having a central hole for allowing the bearing pedestal to pass therethrough, and the separating member being configured to separate the housing into an oil storage chamber and a motor chamber with the motor provided therein. The separating member is constructed to have an annular groove opening into the oil storage chamber. The oil supply mechanism and the horizontal compressor having the oil supply mechanism
(Continued)

can reduce or minimize free space in the motor chamber and/or facilitate a quality inspection on the structure of a pump.

19 Claims, 9 Drawing Sheets

(52) U.S. Cl.
CPC ..... *F04C 2240/30* (2013.01); *F04C 2240/56* (2013.01); *F04C 2240/806* (2013.01); *F04C 2240/809* (2013.01)

(56) References Cited

U.S. PATENT DOCUMENTS

| | | | | | |
|---|---|---|---|---|---|
| 5,579,653 | A * | 12/1996 | Sugiyama | ..... | F04C 23/008 62/508 |
| 5,829,959 | A * | 11/1998 | Tsubono | ..... | F04C 27/005 418/57 |
| 6,050,794 | A | 4/2000 | Noboru et al. | | |
| 2006/0057010 | A1* | 3/2006 | Tsubono | ..... | F04C 28/16 418/55.5 |
| 2008/0226483 | A1* | 9/2008 | Iwanami | ..... | F01C 21/10 418/97 |
| 2019/0145414 | A1 | 5/2019 | Cui et al. | | |

FOREIGN PATENT DOCUMENTS

| | | | | | |
|---|---|---|---|---|---|
| CN | 106812701 | A | | 6/2017 | |
| CN | 207795583 | U | | 8/2018 | |
| EP | 0574104 | A1 | | 12/1993 | |
| EP | 0809029 | A2 | | 11/1997 | |
| EP | 2034187 | A | | 3/2009 | |
| JP | 11006480 | A | * | 1/1999 | |
| JP | 2007218214 | A | | 8/2007 | |
| JP | 2011157974 | A | | 8/2011 | |
| KR | 20100137337 | A | * | 8/2009 | ..... F04C 18/02 |
| WO | WO-2017190651 | A1 | * | 11/2017 | ..... F04C 18/0215 |

OTHER PUBLICATIONS

English translation of KR20100137337 by Espacenet May 6, 2022.*
English translation of WO2017190651 by PE2E, Oct. 30, 2022.*
International Search Report (in English and Chinese) and Written Opinion of the International Searching Authority issued in PCT/CN2018/123893, dated Apr. 1, 2019; ISA/CN.
Extended European Search Report regarding Application No. 18893372.5 dated May 7, 2021.

* cited by examiner

OIL SUPPLYING MECHANISM, AND HORIZONTAL COMPRESSOR HAVING SAME

CROSS-REFERENCE TO RELATED APPLICATIONS

This application is the national phase of International Application No.PCT/CN2018/123893 titled "OIL SUPPLYING MECHANISM, AND HORIZONTAL COMPRESSOR HAVING SAME" and filed on Dec. 26, 2018, which claims priority to Chinese Patent Application No. 201721861898.7, titled "OIL SUPPLYING MECHANISM, AND HORIZONTAL COMPRESSOR HAVING SAME", filed with the China National Intellectual Property Administration on Dec. 27, 2017, which is incorporated herein by reference in its entirety.

FIELD

The present disclosure relates to the field of compressor, and in particular to a horizontal scroll compressor having an improvement on its oil supply mechanism.

BACKGROUND

A compressor generally includes a housing, a compression mechanism housed in the housing, a motor that provides power to the compression mechanism, a rotating shaft driven by the motor, and an oil supply mechanism that supplies lubricating oil to various moving parts of the compressor. For a vertical compressor, an oil sump is generally provided at the bottom of the compressor housing and an oil pump is provided at the bottom end of the rotating shaft to pump the lubricating oil preserved in the oil sump to an oilhole axially extending in the rotating shaft, thereby supplying lubricating oil to the various moving parts of the compressor.

However, in some applications, due to, for example, space limitations, a horizontal compressor is required. Since the horizontal compressor cannot naturally form an oil sump at a tail end of the rotating shaft, some oil supply mechanisms for the horizontal compressor are provided to realize the preservation and delivery of lubricating oil. For example, for a high-pressure side compressor, a partition plate may be provided to separate out two compartments with a pressure difference (a discharge pressure difference) in the high-pressure region to form in the lower pressure compartment an oil sump which can rise by means of the pressure difference, so that the high-pressure lubricating oil can be delivered to the oil pump (a single oil pump) at the tail end of the rotating shaft. However, according to this arrangement, since the pressure drop varies under different working conditions, the oil supply is greatly affected by the working conditions, resulting in poor consistency of the oil supply throughout the whole operating range of the compressor. For another example, for a low-pressure side compressor, the high-temperature and high-pressure lubricating oil in the high-pressure region can be introduced into the oil pump at the tail end of the rotating shaft, and a double-layer housing can be used to form an oil sump in the low-pressure region, or a vertical and straight partition member can be used to separate out an individual oil sump in the low-pressure region. However, in these oil supply solutions for low-pressure side compressors, the operating performance of the compressor may be adversely affected or a restricting structure with a complicated structure for restricting the amount of oil supplied may be required due to the need to introduce the high-temperature and high-pressure lubricating oil from the high-pressure region, or at least the radial dimension is disadvantageously enlarged due to the need to provide the double-layer housing. As for the related solution in which the individual oil sump is separated out in the low-pressure region by means of the vertical and straight partition member, due to, for example, lack of consideration of fully exploiting free space in the motor chamber or lack of consideration of the operability of quality inspection of the oil pump, certain problems may exist therein.

Here, it should be noted that, the technical contents provided in this section are only for facilitating understanding of the present disclosure, but do not necessarily constitute the prior art.

SUMMARY

A general summary of the present disclosure is provided in this section, rather than the full scope of the present disclosure or a comprehensive disclosure of all features of the present disclosure.

An object of the present disclosure is to provide an oil supply mechanism capable of reducing or minimizing free space in a motor chamber.

Another object of the present disclosure is to provide an oil supply mechanism capable of reducing the overall size of a horizontal compressor when the size of an oil storage chamber is fixed.

Another object of the present disclosure is to provide an oil supply mechanism capable of reducing or minimizing the free space in the motor chamber while allowing a stable engagement of a partition member and a housing.

Another object of the present disclosure is to provide an oil supply mechanism capable of achieving reliable and stable connection and sealing of a partition member and a bearing seat.

Another object of the present disclosure is to provide an oil supply mechanism capable of achieving reducing or minimizing the free space in the motor chamber while appropriately avoiding interference with related components around the bearing seat.

Another object of the present disclosure is to provide an oil supply mechanism through which a functional test can be conveniently performed on a pump structure.

Another object of the present disclosure is to provide an oil supply mechanism capable of avoiding improperly increasing an axial length of a pump-bearing seat assembly.

Another object of the present disclosure is to provide a horizontal compressor associated with the above oil supply mechanism.

In order to achieve one or more of the above objects, according to one aspect of the present disclosure, an oil supply mechanism for a horizontal compressor is provided. The horizontal compressor includes a housing, a motor, a rotating shaft driven by the motor, and a bearing seat supporting the rotating shaft. The oil supply mechanism includes a partition member. The partition member is ring-shaped and has a central hole allowing the bearing seat to pass through, and the partition member is configured to separate out in the housing an oil storage chamber and a motor chamber in which the motor is provided. The partition member is configured to have an annular groove opened toward the oil storage chamber.

In the oil supply mechanism, a radially outer portion of the partition member is connected to an inner peripheral surface of the housing and a radially inner portion of the partition member is connected to an outer peripheral surface of the bearing seat.

In the oil supply mechanism, the housing includes a housing body and an end cover, and the radially outer portion of the partition member is connected to both the housing body and the end cover.

In the oil supply mechanism, the partition member includes a partition member body, an inner flange portion serving as a radially inner portion of the partition member that extends away from the oil storage chamber, an outer flange portion serving as a radially outer portion of the partition member that extends toward the oil storage chamber, and a bent portion located between the partition member body and the inner flange portion and protruding toward the oil storage chamber. Thereby, the partition member body, the outer flange portion, and the bent portion together define the annular groove.

In the oil supply mechanism, the partition member includes a partition member body, an inner flange portion serving as a radially inner portion of the partition member, and an outer flange portion serving as a radially outer portion of the partition member, wherein the inner flange portion and the outer flange portion extend toward the oil storage chamber, and, the partition member body, the inner flange portion, and the outer flange portion thereby together define the annular groove.

In the oil supply mechanism, the oil supply mechanism further includes an annular sealing member provided between the radially inner portion of the partition member and the outer peripheral surface of the bearing seat.

In the oil supply mechanism, a sealing member groove is provided on the inner peripheral surface of the radially inner portion of the partition member and/or on the outer peripheral surface of the bearing seat, and the annular sealing member is accommodated in the sealing member groove.

In the oil supply mechanism, a ridge is provided on the outer peripheral surface of the radially outer portion of the partition member, and the ridge is interposed between the housing body and the end cover of the housing.

In the oil supply mechanism, the partition member is an integral part formed by a deep drawing process.

In the oil supply mechanism, the partition member is such configured that the partition member body of the partition member defining the annular groove is offset toward the motor chamber and is closer to one end of the motor.

In the oil supply mechanism, the oil supply mechanism further includes a pump device attached to the bearing seat at one end of the rotating shaft, so that the pump device and the bearing seat constitute a pump-bearing seat assembly. The pump device includes a first pump configured to deliver the lubricating oil in the motor chamber to the oil storage chamber, and an oil discharge pipe for the first pump. A first port of the oil discharge pipe is connected to the pump-bearing seat assembly, and a second port of the oil discharge pipe enters the oil storage chamber through an opening provided at the partition member.

In the oil supply mechanism, the oil supply mechanism further includes a pump device attached to the bearing seat at one end of the rotating shaft, so that the pump device and the bearing seat constitute a pump-bearing seat assembly. The pump device includes a first pump configured to deliver the lubricating oil in the motor chamber to the oil storage chamber, a second pump configured to deliver the lubricating oil in the oil storage chamber to the oilhole in the rotating shaft, a first oil inlet-pipe for the first pump and a second oil inlet-pipe for the second pump extending substantially vertically downward from the pump-bearing seat assembly on the motor chamber side and on the oil storage chamber side respectively.

In the oil supply mechanism, the first oil inlet-pipe and/or the second oil inlet-pipe are detachably connected to the pump-bearing seat assembly.

In the oil supply mechanism, the first oil inlet-pipe and/or the second oil inlet-pipe have a threaded structure, and thereby can be screwed to the pump-bearing seat assembly, or, the first oil inlet-pipe and/or the second oil inlet-pipe are fixed to the pump-bearing seat assembly by threaded fasteners and positioning pins.

In the oil supply mechanism, the horizontal compressor further includes a bearing seat bracket for fixing the bearing seat and the partition member is a component different from the bearing seat bracket.

In order to achieve one or more of the above objects, according to another aspect of the present disclosure, an oil supply mechanism for a horizontal compressor is provided. The horizontal compressor includes a housing, a motor, a rotating shaft driven by the motor, and a bearing seat supporting the rotating shaft. The oil supply mechanism includes a partition member and a pump device. The partition member is configured to separate out in the housing an oil storage chamber and a motor chamber in which the motor is provided, and the pump device is attached to the bearing seat at one end of the rotating shaft, so that the pump device and the bearing seat constitute a pump-bearing seat assembly. The pump device includes a first pump configured to deliver the lubricating oil in the motor chamber to the oil storage chamber and an oil discharge pipe for the first pump. A first port of the oil discharge pipe is connected to the pump-bearing seat assembly on the motor chamber side, and a second port of the oil discharge pipe enters the oil storage chamber from the motor chamber side through an opening provided at the partition member.

In order to achieve one or more of the above objects, according to another aspect of the present disclosure, a horizontal compressor is provided. The horizontal compressor has an oil supply mechanism as described above.

The horizontal compressor is a low-pressure side scroll compressor.

According to the present disclosure, since the partition member defines the annular groove having a larger depth opening toward the oil storage chamber by, for example, a deep drawing process, it is possible to reduce or minimize the free space (useless free space) in the motor chamber, and thereby the overall size (especially the axial size) of the horizontal compressor can be reduced when the size of the oil storage chamber is fixed. In addition, by means of the partition member having the annular groove and the outer flange portion extending toward the oil storage chamber, it is possible to reduce or minimize the free space in the motor chamber while allowing the partition member to be respectively connected with the housing body and the end cover so as to realize a stable engagement of the partition member, the housing body and the end cover. In addition, by means of the partition member having the inner flange portion, it is possible to realize reliable and stable connection and sealing of the partition member and the bearing seat. In addition, by means of the partition member having the bent portion protruding toward the oil storage chamber, it is possible to reduce or minimize the free space in the motor chamber while appropriately avoiding interference with related components around the bearing seat.

In addition, by providing the split-type oil discharge pipe located outside the pump-bearing seat assembly, the functional test (quality inspection) can be conveniently performed on the first pump, and, compared with a solution in which an oil discharge passage is provided inside the pump-bearing seat assembly, the structure is simplified and improper increase in the axial length of the pump-bearing seat assembly (especially the bearing seat) due to the provision of the oil discharge passage inside the pump-bearing seat assembly is avoided.

BRIEF DESCRIPTION OF THE DRAWINGS

The features and advantages of one or more embodiments of the present disclosure will become more readily understood from the following description with reference to the accompanying drawings in which.

DETAILED DESCRIPTION OF THE EMBODIMENTS

The present disclosure is described in detail hereinafter by means of specific embodiments with reference to the accompanying drawings. The following detailed description of the present disclosure is for explanation only and is by no means intended to limit the present disclosure and the applications or usages thereof.

First, the structure of a horizontal compressor 10 having an oil supply mechanism 100 according to the present disclosure is briefly described with reference to FIG. 1.

In the illustrated example, the horizontal compressor 10 is a low-pressure side scroll compressor. However, it is conceivable that the oil supply mechanism 100 according to the present disclosure may be applied to other horizontal compressors.

Figure 1:
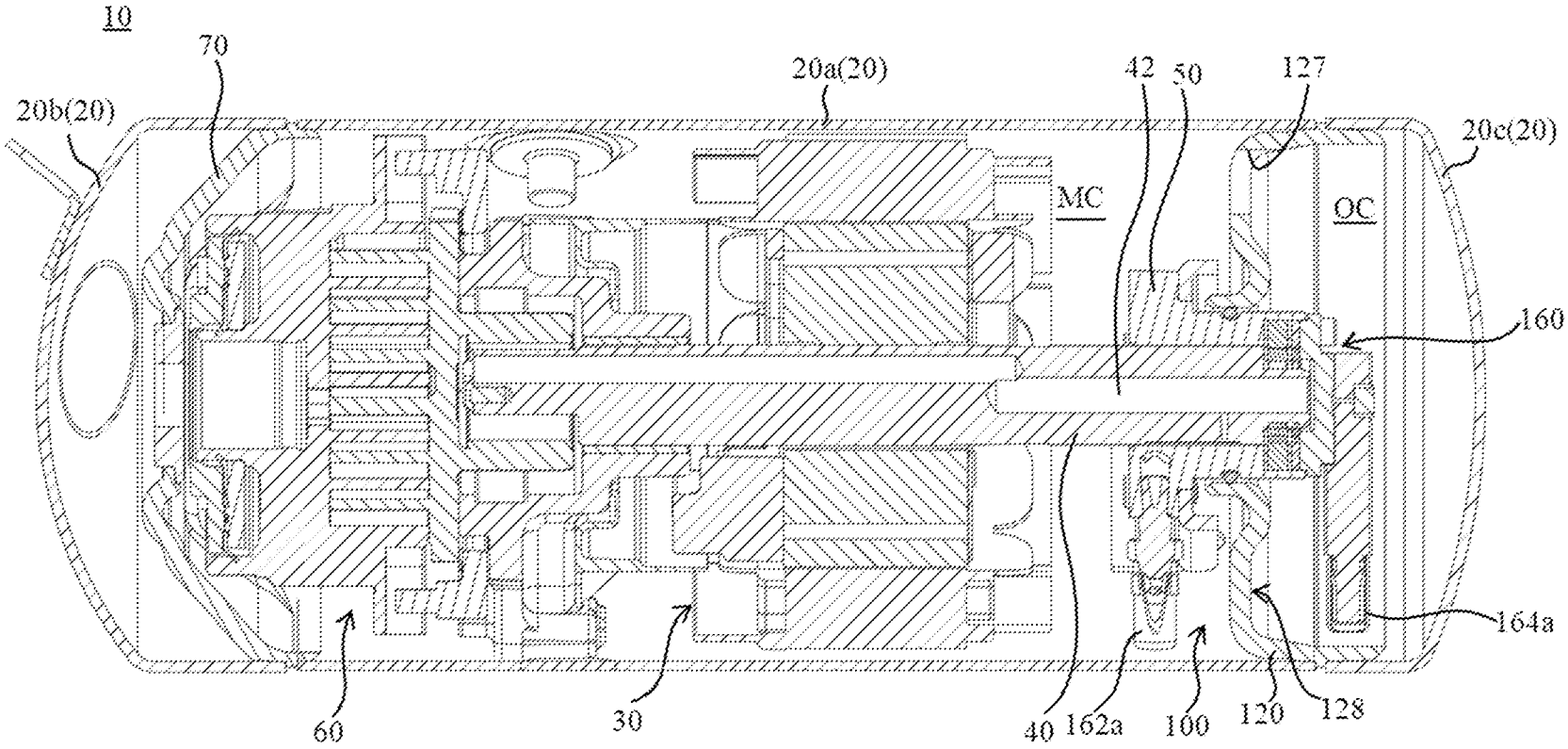
FIG. 1 is a longitudinal sectional view of a horizontal compressor having an oil supply mechanism according to an exemplary embodiment of the present disclosure.

As shown in FIG. 1, the horizontal compressor 10 includes a housing 20, a motor 30, a rotating shaft 40 driven by the motor 30, and a bearing seat 50 supporting the rotating shaft 40. The housing 20 includes a housing body 20*a*, and a first end cover 20*b* and a second end cover 20*c* which are respectively provided at two ends of the housing body 20*a*. In addition, the horizontal compressor 10 further includes a compression mechanism 60 and a partition plate (muffler plate) 70. The compression mechanism 60 is driven by the rotating shaft 40 to compress the working fluid (for example, refrigerant). The partition plate 70 separates the internal space defined by the housing 20 (specifically, by the housing body 20*a*, the first end cover 20*b*, and the second end cover 20*c*) into a high-pressure region (located on the left side of the partition plate 70 as shown in FIG. 1) and a low-pressure region (located on the right side of the partition plate 70 as shown in FIG. 1).

Figure 2:
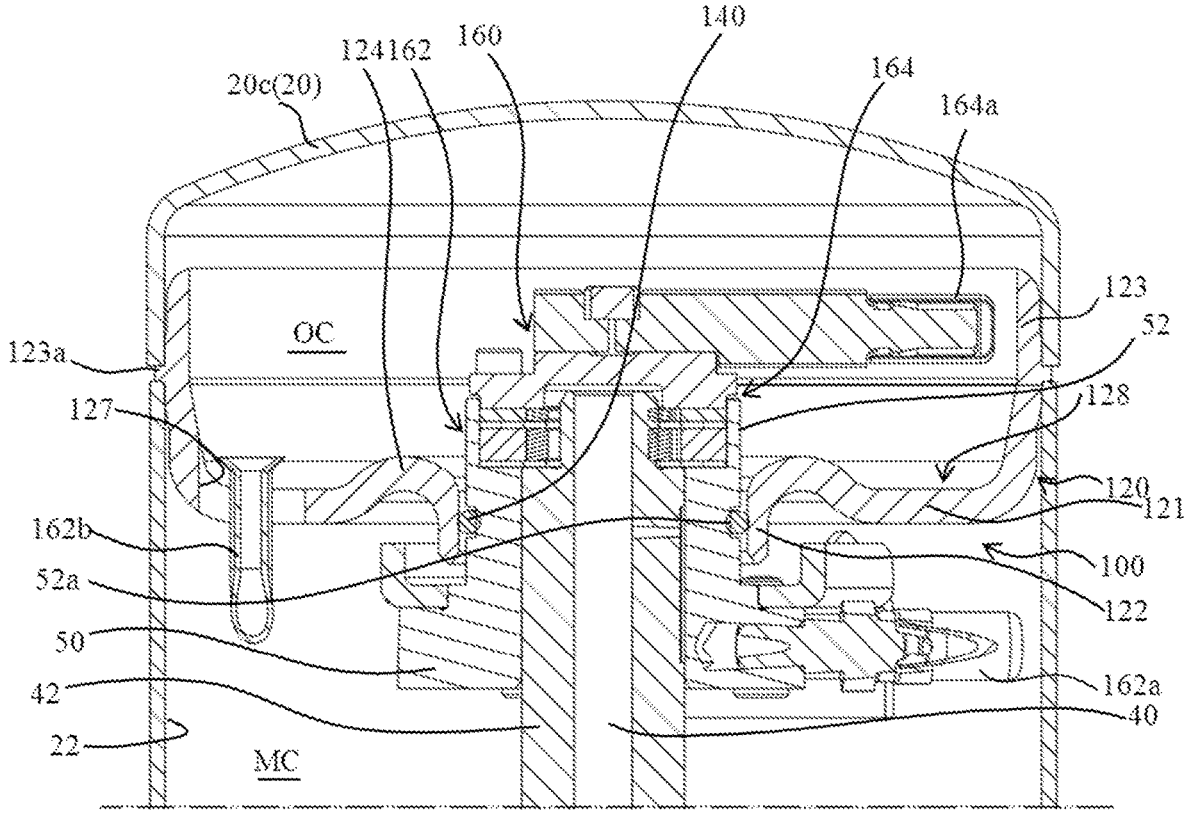
FIG. 2 is a partial enlarged view of a portion of the longitudinal section shown in FIG. 1.
Figure 3:
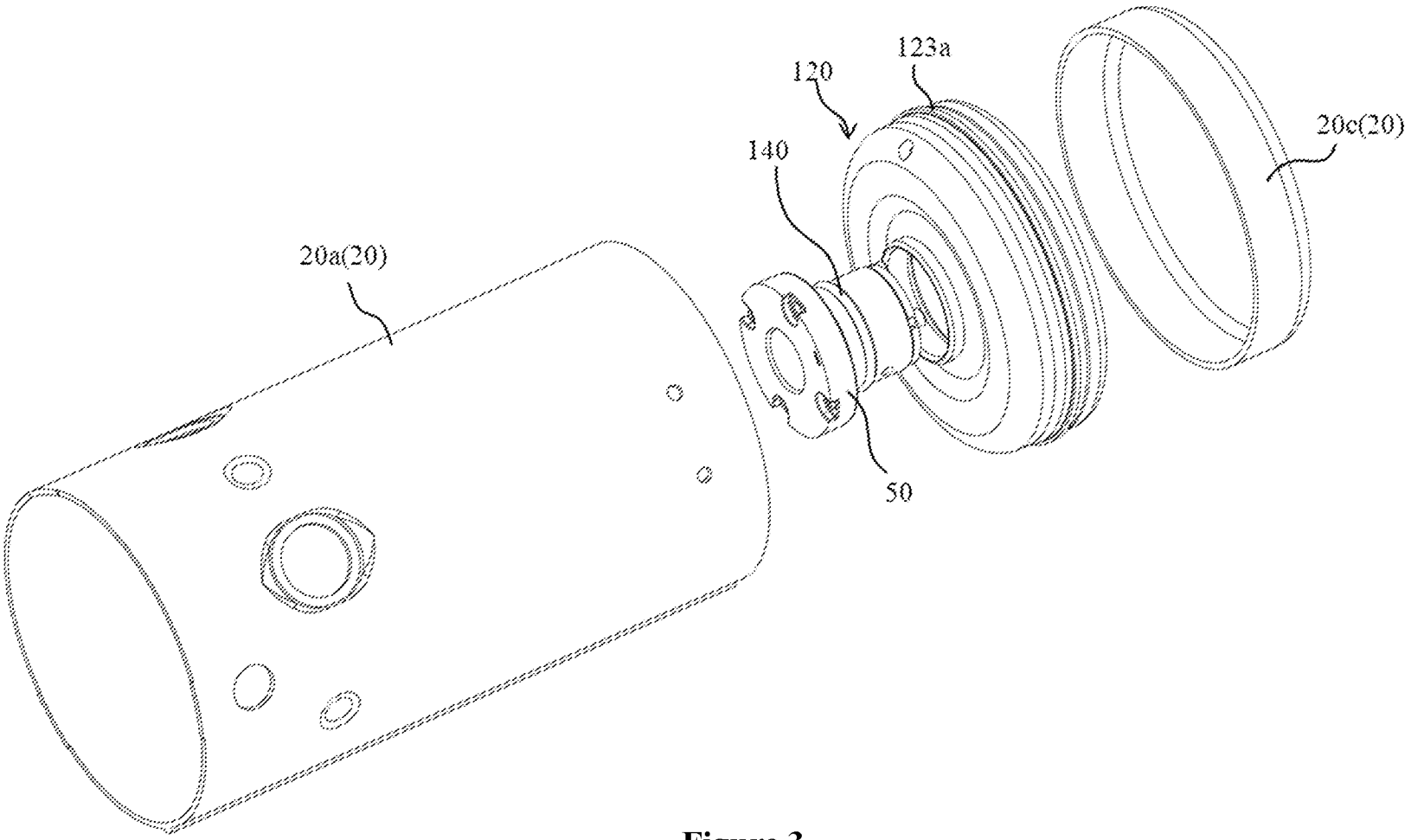
FIG. 3 is a perspective exploded view of a portion of the horizontal compressor shown in FIG. 1.
Figure 4:
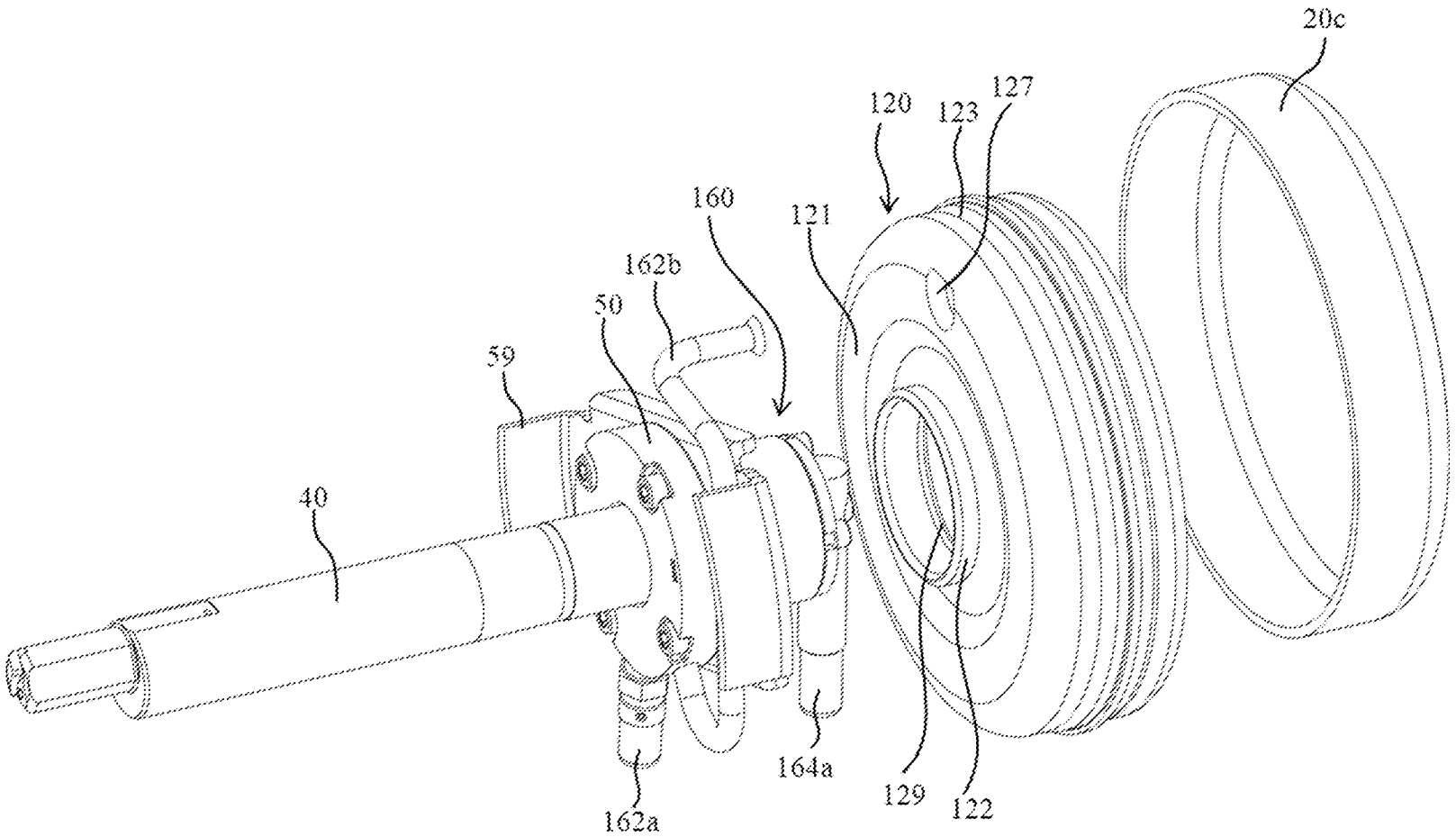
FIG. 4 is a perspective exploded view of another portion of the horizontal compressor shown in FIG. 1.
Figure 5:
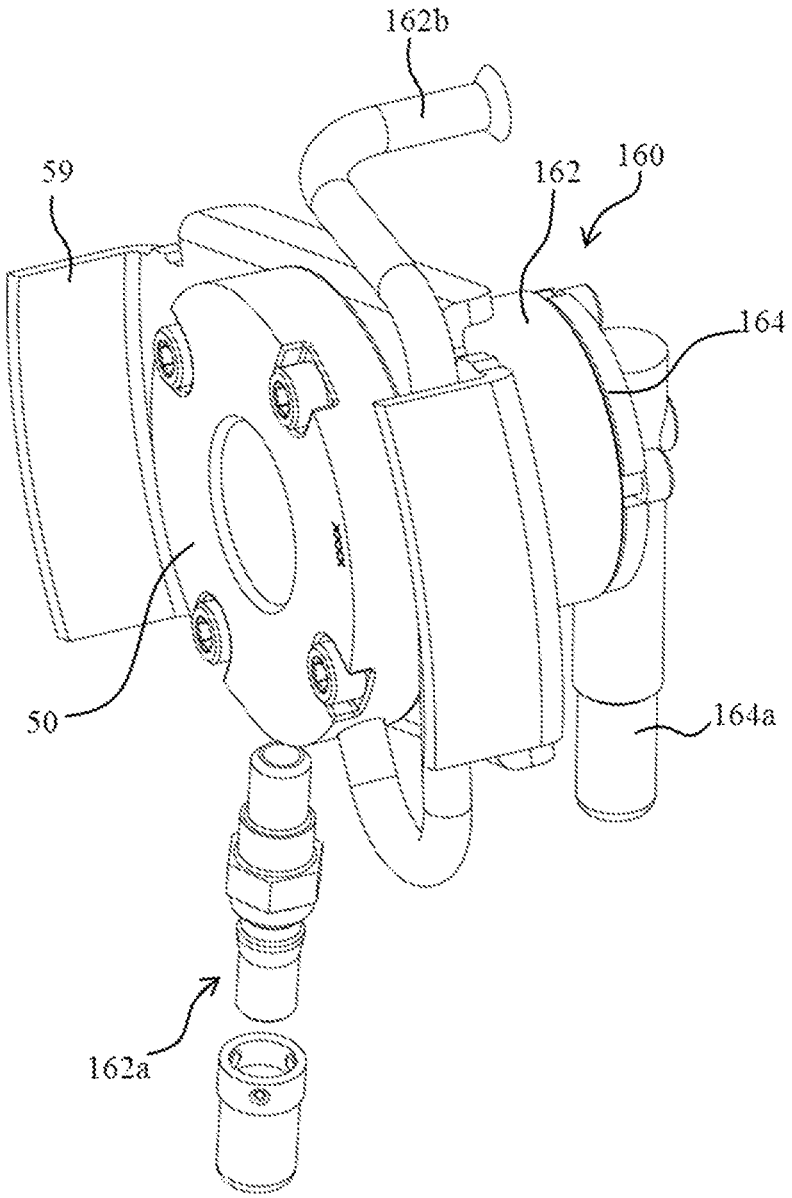
FIG. 5 is a perspective view showing an oil supply mechanism of the horizontal compressor shown in FIG. 1 and related components around the oil supply mechanism.
Figure 6:
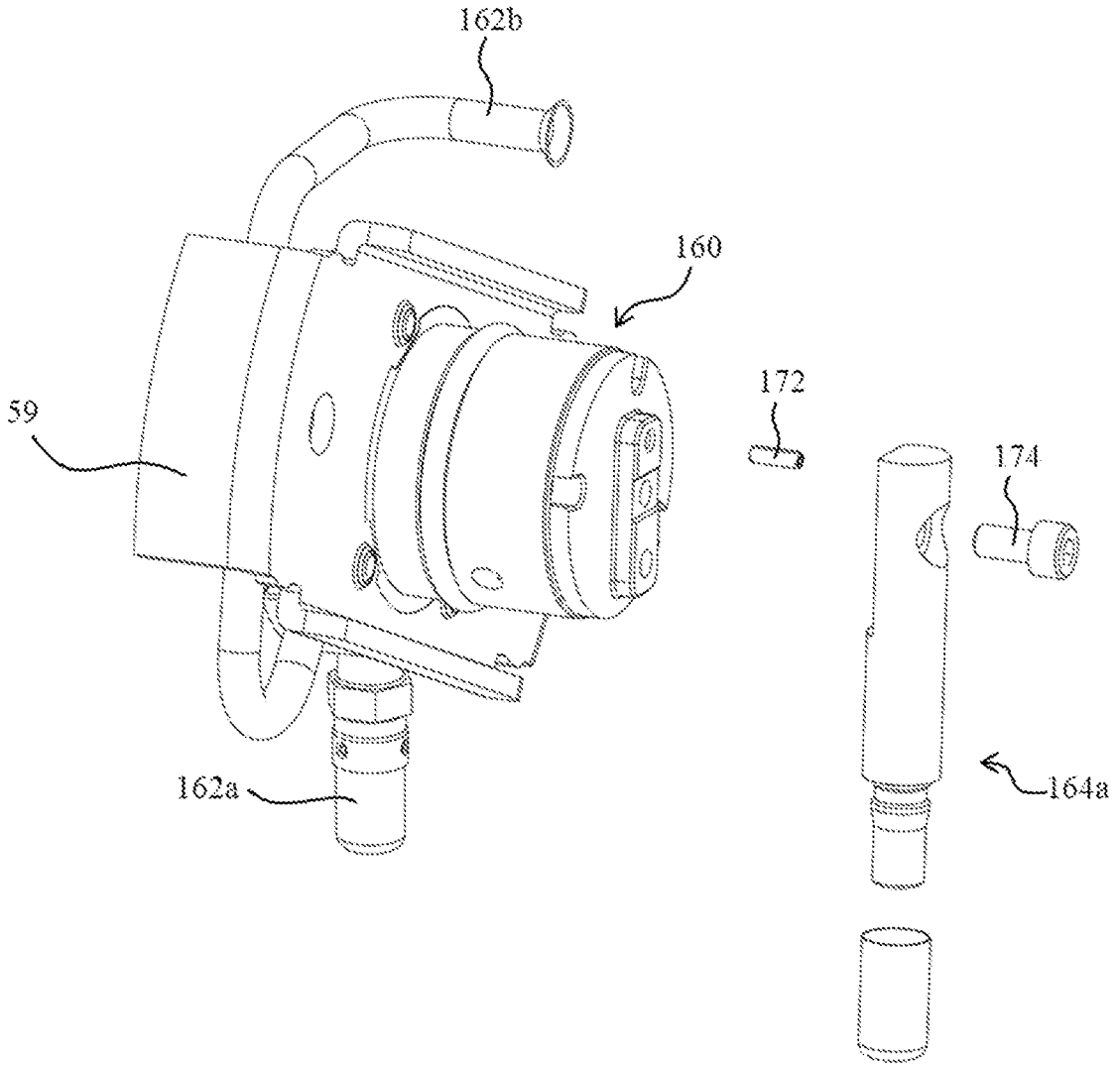
FIG. 6 is another perspective view showing the oil supply mechanism of the horizontal compressor shown in FIG. 1 and related components around the oil supply mechanism.

Further referring to FIGS. 2 to 4, the oil supply mechanism 100 according to the exemplary embodiment of the present disclosure for the horizontal compressor 10 includes a partition member 120. The partition member 120 is in a ring shape (for example, in a substantially circular ring shape) and has a central hole 129 allowing the bearing seat 50 to pass through. The partition member 120 is configured to separate out in the housing 20 an oil storage chamber OC and a motor chamber MC in which the motor 30 is provided. Here, it is conceivable that the oil storage chamber OC located on one side with respect to an axial direction and the motor chamber MC located on the other side with respect to the axial direction are both located in the low-pressure region.

Particularly, a radially outer portion of the partition member 120 is connected to an inner peripheral surface 22 of the housing 20 and a radially inner portion of the partition member 120 is connected to an outer peripheral surface 52 of the bearing seat 50. Thereby, the oil storage chamber OC and the motor chamber MC are simply and reliably separated out in the housing 20 by the partition member 120.

In the illustrated example, the radially outer portion of the partition member 120 is connected to both the housing body 20*a* and the second end cover 20*c*. In this way, the three of the housing body 20*a*, the second end cover 20*c* and the partition member 120 can be more stably engaged together.

According to the present disclosure, the partition member 120 is configured to have an annular groove 128 opening toward the oil storage chamber OC.

In the example shown in FIGS. 1 to 4, the partition member 120 includes a partition member body 121, an inner flange portion 122 serving as a radially inner portion of the partition member 120 that extends away from the oil storage chamber OC, an outer flange portion 123 serving as a radially outer portion of the partition member 120 that extends toward the oil storage chamber OC, and a bent portion 124 provided between the partition member body 121 and the inner flange portion 122 and protruding toward the oil storage chamber OC. Thereby, the partition member body 121, the outer flange portion 123, and the bent portion 124 together define the annular groove 128. That is, the annular groove 128 is reliably formed by the partition member 120 itself without resorting to other components such as the bearing seat 50.

A ridge 123*a* is provided on an outer peripheral surface of the radially outer portion (that is, the outer flange portion 123) of the partition member 120. The ridge 123*a* is interposed between the housing body 20*a* and the end cover 20*c* of the housing 20. In this way, after the housing body 20*a* and the second end cover 20*c* are assembled together, the three of the housing body 20*a*, the second end cover 20*c* and the partition member 120 are conveniently, for example, welded together at the ridge 123*a* from the outside of the housing 20.

The oil supply mechanism 100 further includes an annular sealing member 140 provided between the radially inner portion (that is, the inner flange portion 122) of the partition member 120 and the outer peripheral surface 52 of the bearing seat 50. In this way, the partition member 120 and the bearing seat 50 can be connected to each other by the annular sealing member 140 (herein, the partition member 120 and the bearing seat 50 may or may not contact each other). Thereby, especially in a case that the radially outer portion of the partition member 120 is connected to the inner peripheral surface 22 of the housing 20, the connection and sealing between the partition member 120 and the bearing seat 50 can be realized simply by means of the annular sealing member 140 without resorting to other fastening devices.

In some examples, a sealing member groove 122*a* (shown in FIGS. 7 and 9) may be provided on the inner peripheral surface of the radially inner portion of the partition member 120 (that is, the inner flange portion 122), and the annular sealing member 140 can be accommodated in the sealing member groove 122*a*. In some other examples, a sealing member groove 52*a* (shown in FIG. 2) may be provided on the outer peripheral surface 52 of the bearing seat 50, and the annular sealing member 140 can be accommodated in the sealing member groove 52*a*. In addition, it is conceivable that a sealing member groove for accommodating the annular sealing member 140 may be provided on both the inner peripheral surface of the radially inner portion of the partition member 120 and the outer peripheral surface 52 of the bearing seat 50. Since the sealing member groove for accommodating the annular sealing member 140 is provided, the connection and sealing between the partition member 120 and the bearing seat 50 can be further reliably achieved.

In a preferred example, the partition member 120 is an integral part formed by a deep drawing process.

Particularly, through the deep drawing process, the partition member 120 is such configured that the partition member body 121 of the partition member 120 defining the annular groove 128 is offset toward the motor chamber MC (offset toward the motor chamber MC relative to the flange portion or the bent portion) and is closer to one end of the motor 30. In other words, the annular groove 128 of the partition member 120 can thereby have a greater depth.

Further referring to FIGS. 5, 6, 8*a* and 8*b*, the oil supply mechanism 100 further includes a pump device 160 attached to the bearing seat 50 at one end of the rotating shaft 40 (the end where the bearing seat 50 is provided). The pump device 160 and the bearing seat 50 (which may be assembled together in advance) constitute a pump-bearing seat assembly. The pump device 160 includes a first pump 162 configured to deliver the lubricating oil in the motor chamber MC to the oil storage chamber OC.

An oil inlet-pipe 162*a* and an oil discharge pipe 162*b* for the first pump 162 are provided. Particularly, a first port of the oil discharge pipe 162*b* is connected to the pump-bearing seat assembly on the motor chamber side, and a second port of the oil discharge pipe 162*b* enters the oil storage chamber OC from the motor chamber side through an opening 127 provided at the partition member 120. By providing the split-type oil discharge pipe 162*b* located outside the pump-bearing seating assembly, a functional test (quality inspection) can be conveniently performed on the first pump 162, and, compared with a solution in which an oil discharge passage is provided inside the pump-bearing seat assembly, the structure is simplified and improper increase in the axial length of the pump-bearing seat assembly (especially the bearing seat) due to the provision of the oil discharge passage inside the pump-bearing seat assembly is avoided.

The pump device 160 furthers include a second pump 164 configured to deliver the lubricating oil in the oil storage chamber OC to an oilhole 42 in the rotating shaft 40. The first pump 162 and the second pump 164 may be combined together (for example, sharing a partition plate therebetween) to form a so-called double pump structure. In addition, the pumpage (for example, capacity) of the first pump 162 may be greater than that of the second pump 164.

In the example shown in FIG. 1, the first oil inlet-pipe 162*a* for the first pump 162 extends substantially vertically downward from the pump-bearing seat assembly on the motor chamber side (for example, a straight pipe), and the second oil inlet-pipe 164*a* for the second pump 164 extends substantially vertically downward from the pump-bearing seat assembly on the oil storage chamber side (for example, a straight pipe). With this double straight tube design, the structure can become more compact to reduce costs and the quality of the pump structure can be better controlled.

The first oil inlet-pipe 162*a* and/or the second oil inlet-pipe 164*a* may be detachably connected to the pump-bearing seat assembly. Particularly, referring to FIG. 6, the first oil inlet-pipe 162*a* and/or the second oil inlet-pipe 164*a* have a threaded structure, and thereby can be screwed to the pump-bearing seat assembly, or, the first oil inlet-pipe 162*a* and/or the second oil inlet-pipe 164*a* are fixed to the pump-bearing seat assembly by threaded fasteners 174 and positioning pins 172, which facilitates assembly, disassembly and quality inspection of the first oil inlet-pipe 162*a* and the second oil inlet-pipe 164*a*.

The horizontal compressor 10 may further include a bearing seat bracket 59 for fixing the bearing seat 50. The partition member 120 is a different member from the bearing seat bracket 59. In other words, the partition member 120 for defining the oil storage chamber OC is independent of the bearing seat bracket 59 for supporting the bearing seat 50. Thereby, the oil storage chamber OC can be formed more reliably, the stable support of the bearing seat 50 can be more reliably achieved, and the connection and sealing between the partition member 120 and the bearing seat 50 is possible to be realized simply by the annular sealing member 140 without resorting to other fastening devices.

According to the exemplary embodiments of the present disclosure, since the partition member defines the annular groove having a larger depth opening toward the oil storage chamber by means of, for example, the deep drawing process, it is possible to reduce or minimize the free space (useless free space) in the motor chamber, and the overall size (especially the axial size) of the horizontal compressor can be reduced when the size of the oil storage chamber is fixed. In addition, by means of the partition member which has the annular groove and the outer flange portion extending toward the oil storage chamber, it is possible to reduce or minimize the free space in the motor chamber while allowing the partition member to be connected respectively with the housing body and the end cover so as to realize a stable engagement of the partition member, the housing body and the end cover. In addition, by means of the partition member having the inner flange portion, it is possible to realize reliable and stable connection and sealing of the partition member and the bearing seat. In addition, by means of the partition member having the bent portion protruding toward the oil storage chamber, it is possible to reduce or minimize the free space in the motor chamber while appropriately avoiding interference with related components around the bearing seat.

Figure 7:
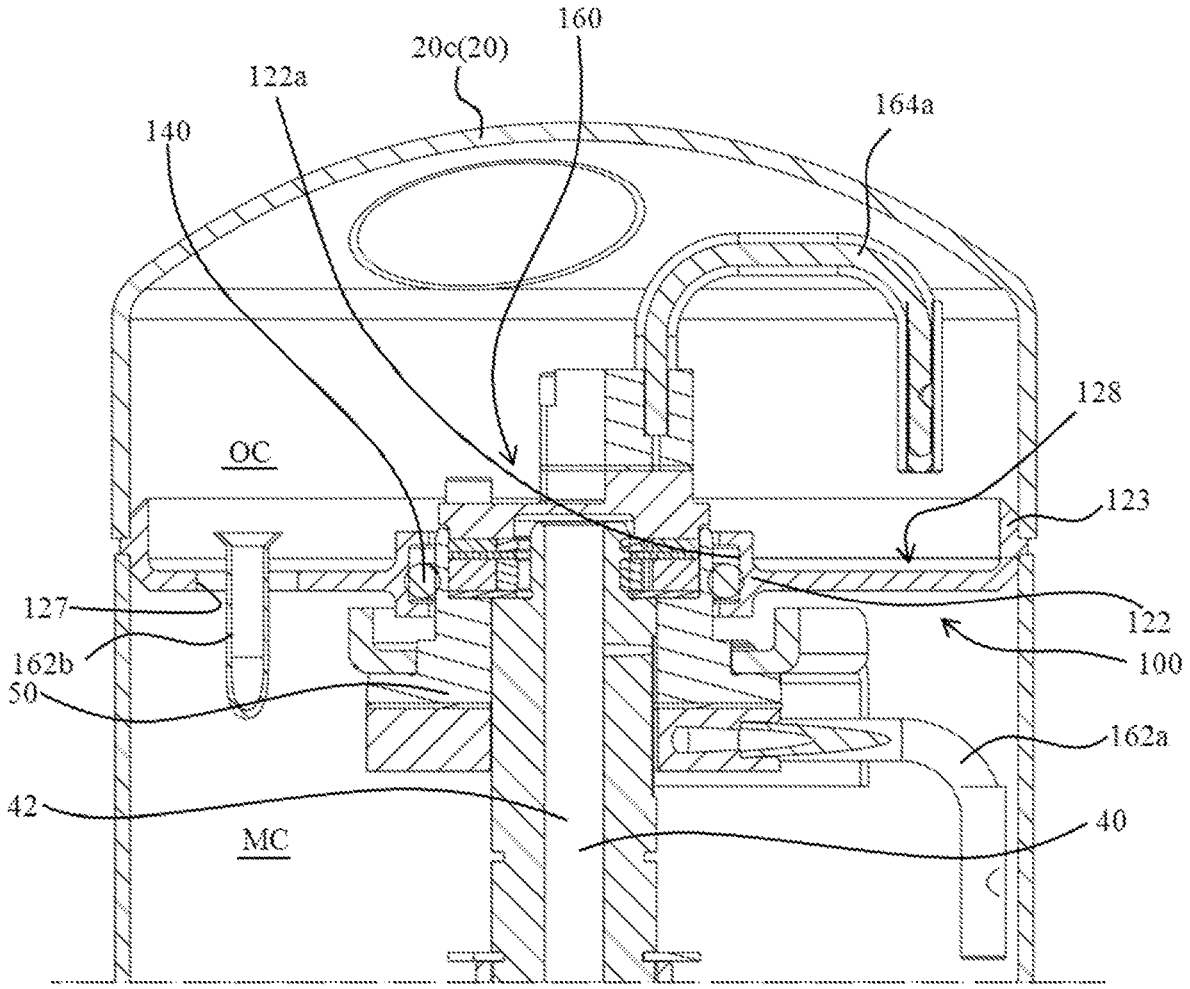
FIG. 7 is a longitudinal sectional view showing a variant of the oil supply mechanism according to the present disclosure.
Figure 8B:
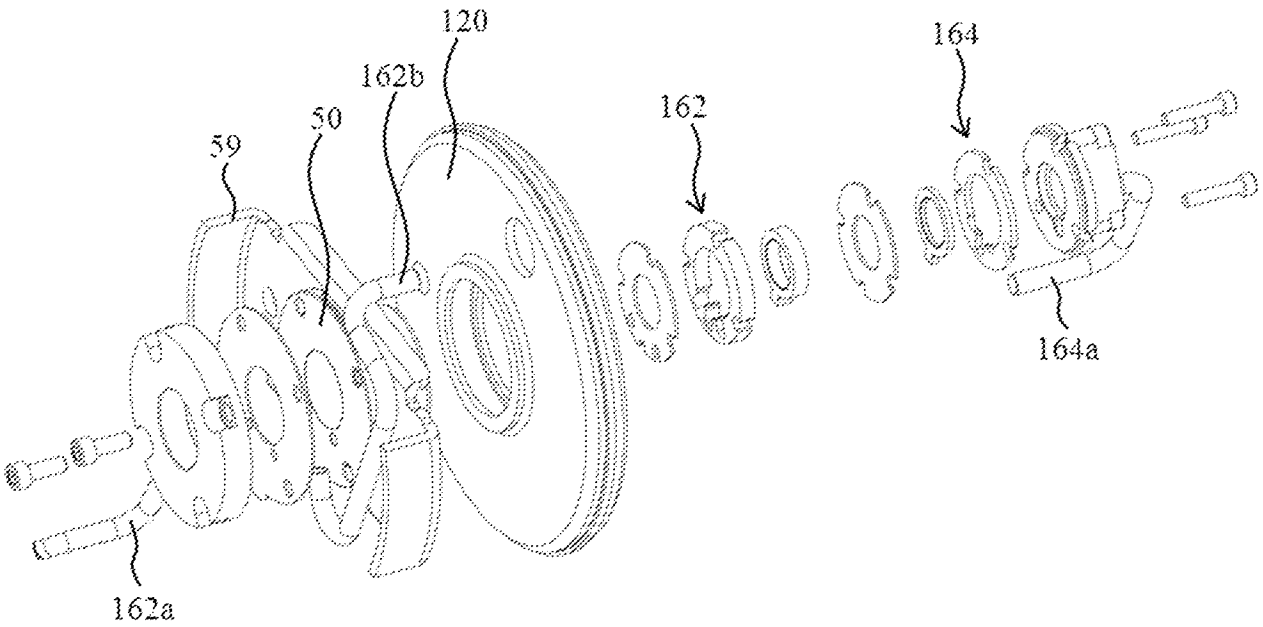
FIG. 8*b* is a perspective exploded view of the variant of the oil supply mechanism according to the present disclosure.
Figure 8A:
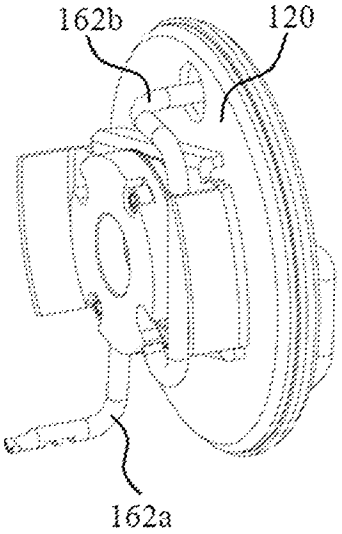
FIG. 8*a* is a perspective assembly view of the variant of the oil supply mechanism according to the present disclosure.

A variant of the oil supply mechanism 100 is described with reference to FIGS. 7, 8*a*, and 8*b*. In this variant, the partition member 120 of the oil supply mechanism 100 is not manufactured by the deep drawing process and the partition member body 121 of the partition member 120 is substantially straight. Besides, in this variant, the first oil inlet-pipe 162*a* for the first pump 162 and the second oil inlet-pipe 164*a* for the second pump 164 are not pipes (for example, straight pipes) extending substantially vertically downward from the pump-bearing seat assembly but bent pipes connected by, for example, brazing. However, in this variant, since the partition member 120 is similarly provided with the annular groove 128 opening toward the oil storage chamber OC, advantageous effects similar to the above exemplary embodiments can also be achieved. Besides, in this variant, the split-type oil discharge pipe 162*b* located outside the pump-bearing seat assembly is also provided, a functional test (quality inspection) can also be conveniently performed on the first pump 162, and, compared with a solution in which an oil discharge passage is provided inside the pump-bearing seat assembly, the structure is also simplified and improper increase in the axial length of the pump-bearing seat assembly (especially the bearing seat) due to the provision of the oil discharge passage inside the pump-bearing seat assembly is avoided.

Figure 9:
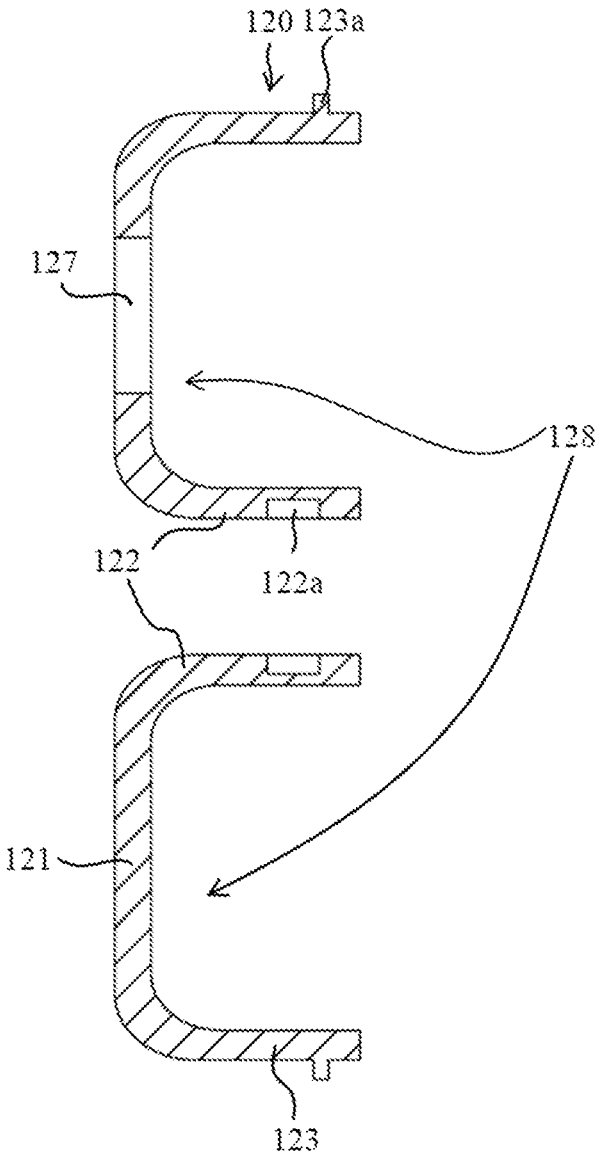
FIG. 9 is a schematic sectional view of another variant of a partition member of the oil supply mechanism according to the present disclosure.

Another variant of the partition member 120 according to the present disclosure is described below with reference to FIG. 9. In this variant, compared with the above exemplary embodiments, the partition member 120 is also an integral part formed by the deep drawing process, but the partition member 120 does not include the bent portion and the extending direction of the inner flange portion 122' is different. Specifically, in this variant, the partition member 120 includes a partition member body 121, an inner flange portion 122' serving as a radially inner portion of the partition member 120, and an outer flange portion 123 serving as a radially outer portion of the partition member 120, wherein the inner flange portion 122' and the outer flange portion 123 extend toward the oil storage chamber OC, and, the partition member body 121, the inner flange portion 122', and the outer flange portion 123 thereby together define the annular groove 128. According to this variant, advantageous effects similar to the above exemplary embodiments can also be achieved.

The oil supply mechanism 100 according to the present disclosure may also have other possible variants. For example, the partition member 120 may not be provided with the annular groove 128 opening toward the oil storage chamber OC but be provided with a split-type oil discharge pipe 162*b* located outside the pump-bearing seat assembly. Moreover, one or more technical features described above may be incorporated in the technical solution that the annular groove 128 is not provided but the split-type oil discharge pipe 162*b* located outside the pump-bearing seat assembly is provided, as long as this incorporation is technically compatible.

Although the present disclosure has been described with reference to the exemplary specific embodiments, it should be understood that the present disclosure is not limited to the specific embodiments described and illustrated in detail herein. Those skilled in the art can make various modifications to the exemplary specific embodiments without departing from the scope defined by the claims.

The invention claimed is:

1. An oil supply mechanism for a horizontal compressor, wherein the horizontal compressor comprises a housing, a motor, and a rotating shaft driven by the motor, and a bearing seat supporting the rotating shaft, the oil supply mechanism comprises a partition member, the partition member is ring-shaped and has a central hole allowing the bearing seat to pass through, and the partition member is configured to separate out in the housing an oil storage chamber and a motor chamber in which the motor is provided, wherein the partition member is configured to have an annular groove opening toward the oil storage chamber, wherein the horizontal compressor further comprises a bearing seat bracket for fixing the bearing seat, and wherein the partition member is a member different from the bearing seat bracket.

2. The oil supply mechanism according to claim 1, wherein a radially outer portion of the partition member is connected to an inner peripheral surface of the housing and a radially inner portion of the partition member is connected to an outer peripheral surface of the bearing seat.

3. The oil supply mechanism according to claim 1, wherein the housing comprises a housing body and an end cover, and a radially outer portion of the partition member is connected to both the housing body and the end cover.

4. The oil supply mechanism according to claim 1, wherein the partition member comprises a partition member body, an inner flange portion serving as a radially inner portion of the partition member that extends away from the oil storage chamber, an outer flange portion serving as a radially outer portion of the partition member that extends toward the oil storage chamber, and a bent portion provided between the partition member body and the inner flange portion and protruding toward the oil storage chamber, thereby the partition member body, the outer flange portion, and the bent portion together define the annular groove.

5. The oil supply mechanism according to claim 1, wherein the partition member comprises a partition member body, an inner flange portion serving as a radially inner portion of the partition member, and an outer flange portion serving as a radially outer portion of the partition member, the inner flange portion and the outer flange portion extend toward the oil storage chamber, thereby the partition member body, the inner flange portion, and the outer flange portion together define the annular groove.

6. The oil supply mechanism according to claim 2, wherein the oil supply mechanism further comprises an annular sealing member provided between the radially inner portion of the partition member and the outer peripheral surface of the bearing seat.

7. The oil supply mechanism according to claim 6, wherein a sealing member groove is provided on an inner peripheral surface of the radially inner portion of the partition member and/or on the outer peripheral surface of the bearing seat, and the annular sealing member is accommodated in the sealing member groove.

8. The oil supply mechanism according to claim 2, wherein a ridge is provided on an outer peripheral surface of the radially outer portion of the partition member, and the ridge is interposed between a housing body and an end cover of the housing.

9. The oil supply mechanism according to claim 1, wherein the partition member is an integral part formed by a deep drawing process.

10. The oil supply mechanism according to claim 9, wherein the partition member is such configured that a partition member body of the partition member defining the annular groove is offset toward the motor chamber and is closer to one end of the motor.

11. The oil supply mechanism according to claim 1, wherein:

the oil supply mechanism further comprises a pump device which is attached to the bearing seat at one end of the rotating shaft, the pump device and the bearing seat constitute a pump-bearing seat assembly, and the pump device comprises a first pump configured to deliver lubricating oil in the motor chamber to the oil storage chamber, and the oil supply mechanism is provided with an oil discharge pipe for the first pump, a first port of the oil discharge pipe is connected to the pump-bearing seat assembly, and a second port of the oil discharge pipe enters the oil storage chamber through an opening provided at the partition member.

12. The oil supply mechanism according to claim 1, wherein:

the oil supply mechanism further comprises a pump device attached to the bearing seat at one end of the rotating shaft, the pump device and the bearing seat constitute a pump-bearing seat assembly, the pump device comprises a first pump configured to deliver lubricating oil in the motor chamber to the oil storage chamber and a second pump configured to deliver lubricating oil in the oil storage chamber to an oilhole in the rotating shaft, and a first oil inlet-pipe for the first pump and a second oil inlet-pipe for the second pump extend substantially vertically downward from the pump-bearing seat assembly on a motor chamber side and on an oil storage chamber side respectively.

13. The oil supply mechanism according to claim 12, wherein the first oil inlet-pipe and/or the second oil inlet-pipe are detachably connected to the pump-bearing seat assembly.

14. The oil supply mechanism according to claim 13, wherein the first oil inlet-pipe and/or the second oil inlet-pipe have a threaded structure and are screwed to the pump-bearing seat assembly, or, the first oil inlet-pipe and/or the second oil inlet-pipe are fixed to the pump-bearing seat assembly by a threaded fastener and a positioning pin.

15. An oil supply mechanism for a horizontal compressor, wherein the horizontal compressor comprises a housing, a motor, and a rotating shaft driven by the motor, and a bearing seat supporting the rotating shaft, the oil supply mechanism comprises a partition member and a pump device, the partition member is configured to separate out in the housing an oil storage chamber and a motor chamber in which the motor is provided, the pump device is attached to the bearing seat at one end of the rotating shaft, the pump device and the bearing seat constitute a pump-bearing seat assembly, and the pump device comprises a first pump configured to deliver lubricating oil in the motor chamber to the oil storage chamber, wherein an oil discharge pipe for the first pump is provided, a first port of the oil discharge pipe is connected to the pump-bearing seat assembly on a motor chamber side, and a second port of the oil discharge pipe enters the oil storage chamber from the motor chamber side through an opening provided at the partition member.

16. A horizontal compressor, characterized by comprising the oil supply mechanism according to claim 1.

17. The horizontal compressor according to claim 16, wherein the horizontal compressor is a low-pressure side scroll compressor in which the motor of the compressor is located in a low-pressure area of the compressor.

18. A horizontal compressor, characterized by comprising the oil supply mechanism according to claim 16.

19. The horizontal compressor according to claim 18, wherein the horizontal compressor is a low-pressure side scroll compressor in which the motor of the compressor is located in a low-pressure area of the compressor.

* * * * *